US005911494A

United States Patent [19]

Lary

[11] Patent Number: 5,911,494

[45] **Date of Patent: *Jun. 15, 1999**

[54] CAP WITH REMOVABLE HALIDE LIGHT

[76] Inventor: Banning G. Lary, 6371 SW. 87 Ter., Miami, Fla. 33143

[ * ] Notice: This patent is subject to a terminal disclaimer.

[21] Appl. No.: 08/977,384

[22] Filed: Nov. 24, 1997

Related U.S. Application Data

[63] Continuation-in-part of application No. 08/731,863, Oct. 21, 1996, Pat. No. 5,738,431, which is a continuation-in-part of application No. 08/402,860, Mar. 13, 1996, Pat. No. 5,567,038.

[51] Int. Cl.[6] ..... F21L 15/14

[52] U.S. Cl. ..... 362/106; 362/191; 362/263

[58] Field of Search ..... 362/105, 106, 362/396, 190, 191, 293, 263; 2/209.13, 175.1, 906

[56] References Cited

U.S. PATENT DOCUMENTS

| | | | |
|---|---|---|---|
| 3,331,958 | 7/1967 | Adler | 362/260 |
| 3,346,153 | 10/1967 | Galasso | 362/105 |
| 4,406,040 | 9/1983 | Cannone | 362/396 |
| 4,593,683 | 6/1986 | Blaha | 362/106 |
| 4,891,555 | 1/1990 | Ahlgren et al. | 313/25 |
| 4,991,068 | 2/1991 | Mickey | 362/106 |
| 5,363,291 | 11/1994 | Steiner | 362/191 |
| 5,386,592 | 2/1995 | Checkeroski | 362/105 |
| 5,412,545 | 5/1995 | Rising | 362/105 |

*Primary Examiner*—Thomas M. Sember
*Attorney, Agent, or Firm*—Michael Klicpera

[57] ABSTRACT

The present invention comprises a common baseball-type hat or headband, to which is attached a wide angled halide light apparatus or an apparatus containing several halide lights positioned in a wide configuration. The object of this invention is to provide an efficient lighting apparatus which embodies the principles of an adjustable cap or headband worn on the head, to which a battery-powered halide lighting apparatus is attached by the hook and loop concept. The wide halide light(s) requires a small amount of electrical current and illuminates a larger area with a brighter illumination than the customary headlight. Furthermore, the halide lights emit less radiation (in the form of heat) than halogen lights.

The design of the apparatus permits diverse tasks to be easily performed, and increases the safety of all movements in the dark. It is particularly advantageous to pilots of aircraft and engineers to illuminate instrument panels in emergency situations when darkness prevails. Applications can be found anyplace a light is beneficial for convenience and pleasure.

11 Claims, 3 Drawing Sheets

FIG. 5
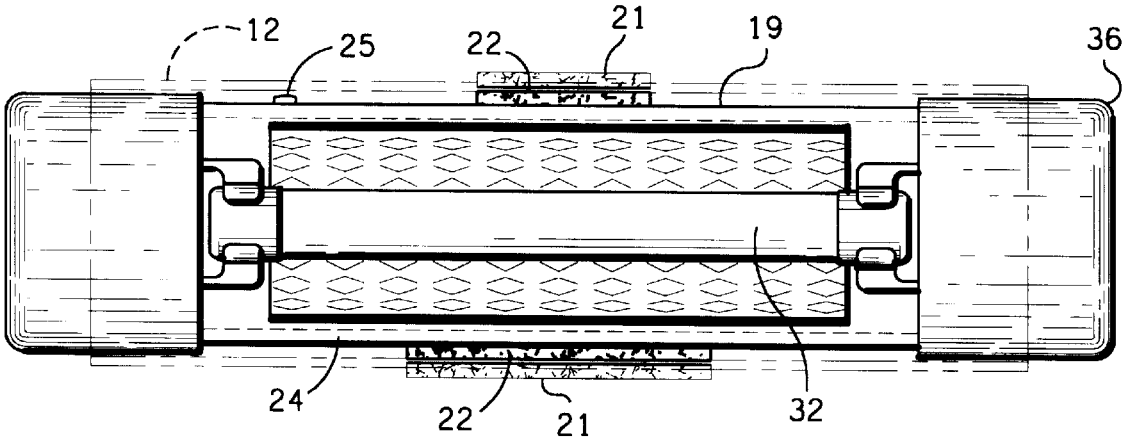
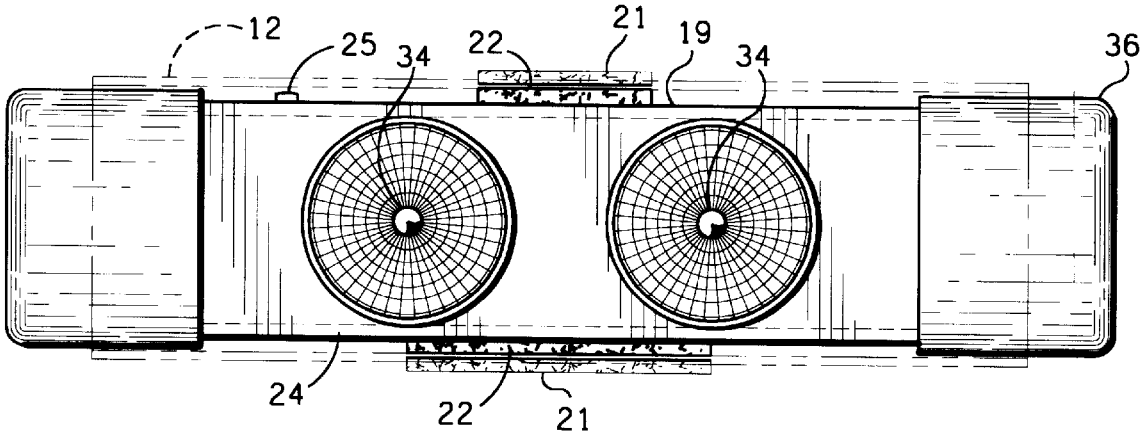
FIG. 6

CAP WITH REMOVABLE HALIDE LIGHT

PRIOR APPLICATION

This application is a continuation-in-part of application Ser. No. 08/731,863 filed on Oct. 21, 1996 now U.S. Pat. No. 5,738,431 which is a continuation-in-part of application Ser. No. 08/402,860 filed on May 13, 1996, now U.S. Pat. No. 5,567,038.

BACKGROUND OF THE INVENTION

The invention relates generally to a light on a cap which illuminates dark areas and permits freedom of both hands and feet to perform various actions with greater efficiency and safety.

Illumination by lighting apparatuses attached to a hat have long been used by mankind to improve his efficiency. Goya, in the 17th Century, placed candles around the hatband to achieve a flickering light which gave an effect he sought to transfer to his paintings. The common miner's hat of the Industrial Revolution made extensive use of the carbide lamp attached to the hat for working in mineral mines and for cave explorations as well. The dry cell battery, the rechargeable, and lithium batteries are currently used in various types of headlights, which are usually spotlights. Such lights are frequently attached to hard hats and to various devices which encircle the head in a band-like fashion. These lights generally have a relatively narrow beam of the flashlight type, which beams can be focused to a given area by a reflector and a focusing lens. This limitation of general illumination of a wide area is characteristic of such headlighting apparatuses. In addition, if one wished to place the light in another location the supporting member must be removed from the subject.

Related applications can be found in the following cross references:

| U.S. PATENT DOCUMENTS | | |
|---|---|---|
| 3,346,153 | 10/67 | Galasso |
| 4,406,040 | 9/83 | Cannone |
| 4,593,683 | 6/86 | Blaha |
| 4,991,068 | 2/91 | Mickey |
| 5,386,592 | 2/95 | Checkeroski |
| 5,412,545 | 5/95 | Rising |
| 5,567,038 | 10/96 | Lary |

SUMMARY OF THE INVENTION

The present invention comprises a common baseball-type hat or headband, to which is attached a wide angled halide light apparatus or a device containing several halide lights positioned in a wide configuration. It is the object of this invention to provide an efficient lighting apparatus which embodies the principles of an adjustable cap or headband worn on the head, to which a battery-powered halide lighting apparatus is attached by the hook and loop concept. The wide halide light(s) requires a small amount of electrical current and illuminates a larger area with a brighter illumination than the customary headlight. Furthermore, the halide lights emit less radiation (in the form of heat) than halogen lights.

The design of the apparatus permits diverse tasks to be easily performed, and increases the safety of all movements in the dark. It is particularly advantageous to pilots of aircraft and engineers to illuminate instrument panels in emergency situations when darkness prevails. Applications can be found anywhere a light is beneficial for convenience and pleasure.

It is further the object of this invention to permit easy removal of the halide light(s) apparatus for illumination in a standalone mode or with an additional attachment mechanism.

A further object of the invention is to permit the attachment of various semi-transparent lens covers to change the color and/or decrease the intensity of the illumination. For example, a red plastic transparent lens cover may be attached to prevent loss of light vision in dark areas.

A further object is to permit the light to be elevated for diffuse illumination of a specific area, or concentrated to a smaller area closer to the operator, such as when examining a specific object or reading.

BRIEF DESCRIPTION OF THE DRAWINGS

FIG. 5 is a front elevation of lighting device 11, showing the single wide angle halide light embodiment of the present invention.

FIG. 6 is a front elevation of an alternate embodiement of the present invention 10 showing multiple halide lights positioned, facing forward, in lighting device 11.

DESCRIPTION OF THE PREFERRED EMBODIMENT

Figure 1:
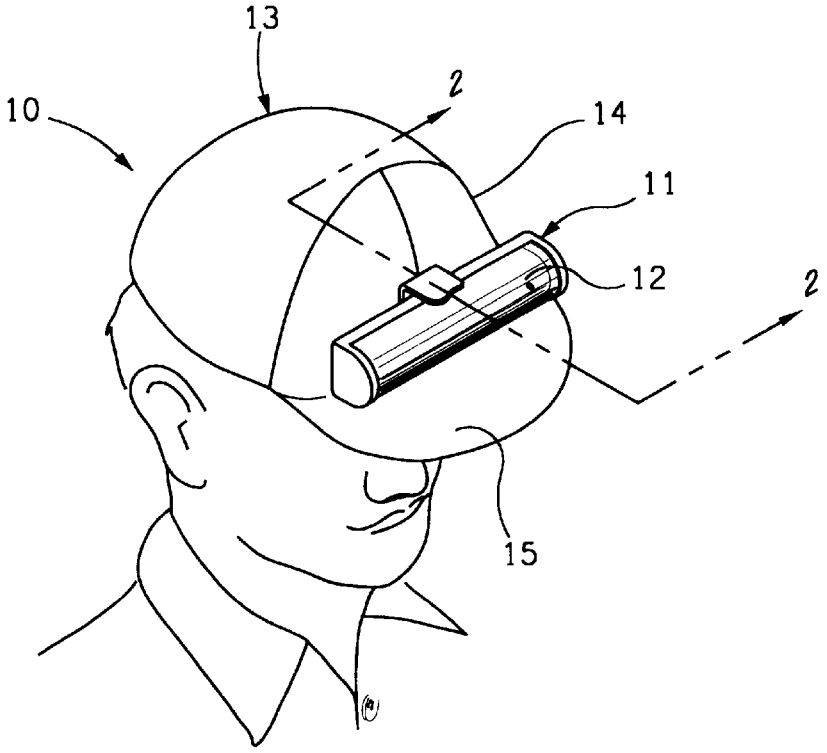
FIG. 1 is a perspective view of apparatus 10 consisting of an adjustable cap 13 with a removal halide lighting device 11, to which may be attached a transparent plastic shield or lens cover 12.

The novel features of this invention, as well as the structure and operation of the invention itself, will best be understood by the accompanying drawings, taken in conjunction with the accompanying description in which similar reference characters refer to similar parts, and in which:

FIG. 1 illustrates the device 10 which is an adjustable cap 13, to which is attached a housing 19 containing the halide light(s). A transparent colored lens cover 12 is removably attached to the body of the lighting device 11. The lighting device 11 with the affixed lens cover 12 are attached to a part of the crown 14, the bill 15 of the cap 13.

Figure 2:
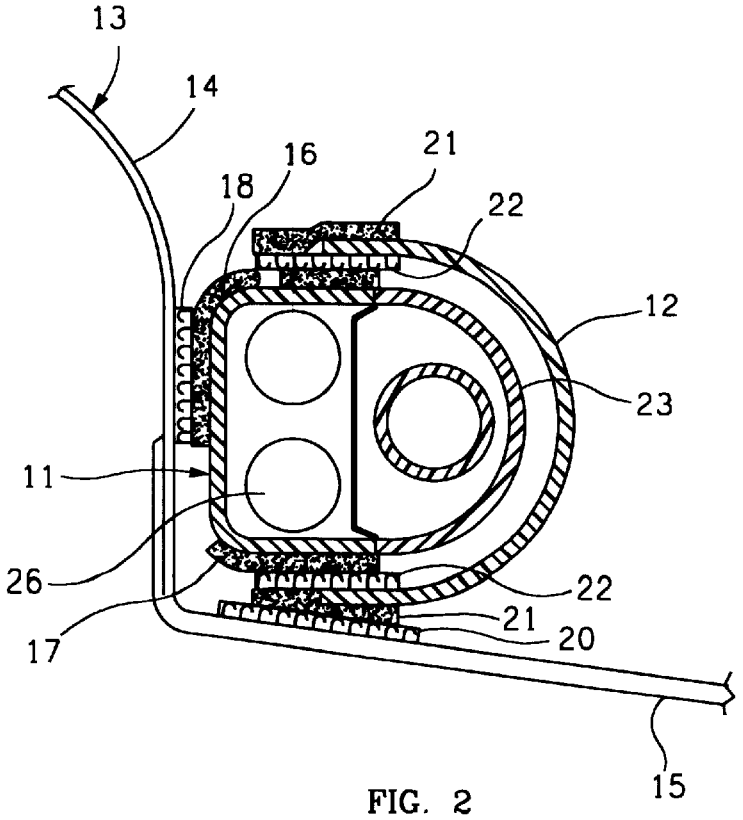
FIG. 2 is a sectional view of the light device 11, and the hooks and loops used to removably join lighting device 11 to crown 14 and bill 15.

FIG. 2 illustrates in more detail the method for attaching the lighting device 11 to the crown 14 and the bill 15 of the cap 13. Flexible segments of loops 16 are adhesively attached to part of the top and back of the lighting device 11. Similarly, additional segments of loops 17 are attached to the bottom of the lighting device 11.

The loops 16 attach to the hooks 18 sewn or adhesively attached by to the crown 14 of the hat 13 and the segment of loops 17 attach to the segment of hooks 20 sewn to the bill 15 of the cap 13.

FIG. 2 also illustrates segments of loops 21 adhesively attached to a portion of the center area of the top of the lens cover 12. These loops being of softer consistency than hooks, serve as a convenience in the attachment and detachment if the lens cover 12 to the body of the lighting device 11. Directly opposing the loops 21 and attached partially to both the adhesive backing of loops and the lens cover is found a segment of hooks 22 which engage the segment of loops 16 and 17 on the lighting device 11.

Further study of FIG. 2 will reveal the segment of loops 16 and 17 engage the segment of hooks 22 and the segment of loops 21 engage the segment of hooks 20, thus securing the lens cover 12 to the body of the lighting device 11 and to the bill 15 of the cap 13. The segment of loops 21 is of small thickness and of limited length, so that it has minimal interference with the attachment of the segment of loops 17 to the segment of hooks 20. It will be observed that when the subject uses pressure on the lighting device 11 to release the loops 16 from the hooks 18, the bill 15 of the cap 13 is deflected downward and greater illumination of proximal objects is achieved.

Further illustrated in FIG. 2 it will be observed that the lighting device is composed of a housing 19, transparent lens shield 23 and batteries 26.

Figure 3:
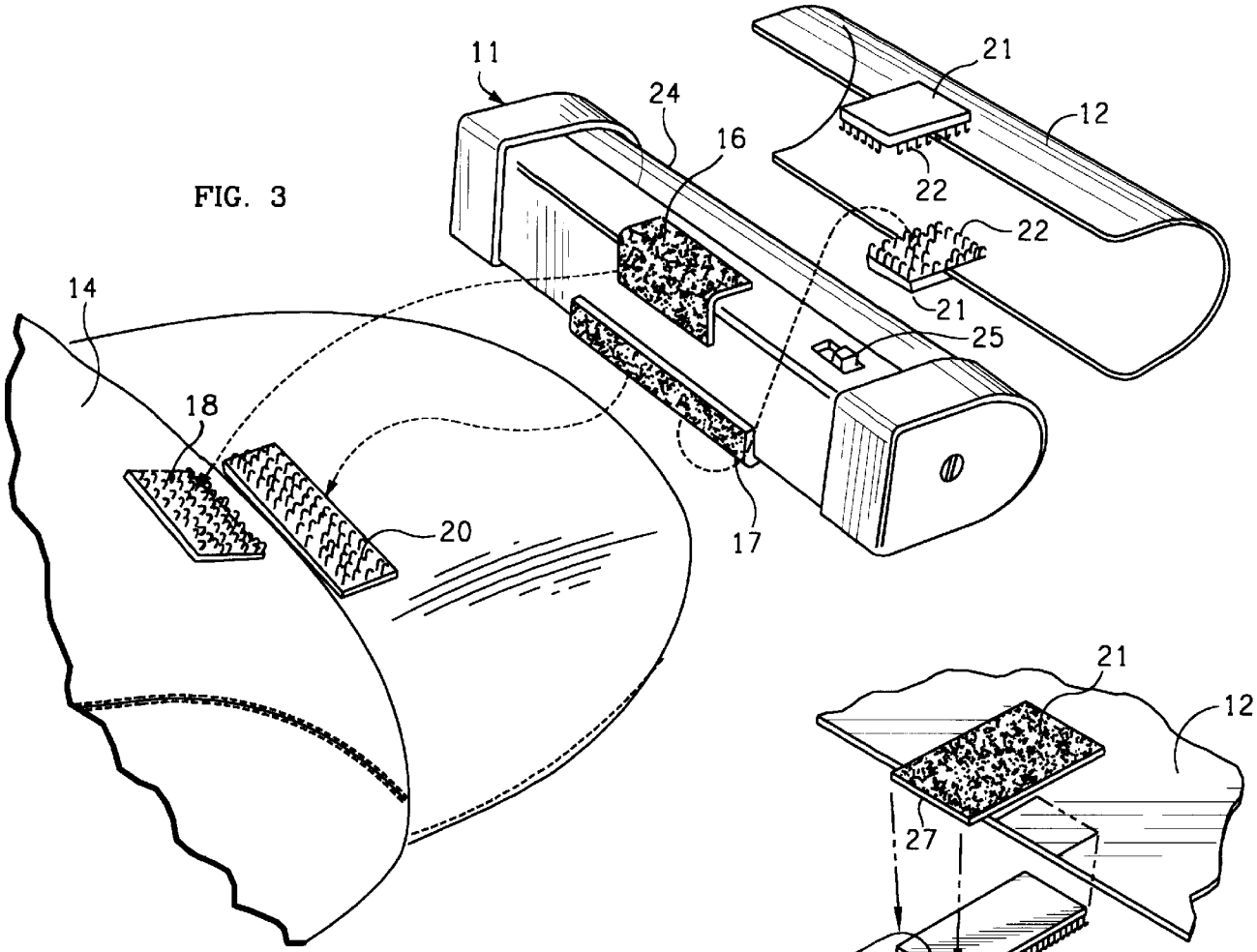
FIG. 3 is a sectional view illustrating in more detail the specific method for attaching each separate and removable member including removable shield or lens cover 12.

FIG. 3 illustrates the transparent lens cover 12 with the centrally positioned and opposingly attached segments of loops 21 to hooks 22 at both the top and bottom. Both segments of hooks are partially attached inside the lens cover 12 to engage the segment of loops 16 and the segment of loops 17, while the segment of loops 21 is outside the lens cover to engage the segment of hooks 20 sewn to the bill 15 of the cap 13, as demonstrated in FIG. 2.

FIG. 3 also demonstrates the position of the switch 25, which is positioned free from the attachment of the lens cover 12 to the lighting device 11.

Further illustrated in FIG. 3 is the approximate length of each segment of loops and hooks. It will be noted that the segment of hooks 20 sewn to the bill of the cap 13 is shorter than the segment of loops 17 attached to the lighting device 11. Similarly, the segment of hooks 18 sewn to the crown of the hat 14 is shorter thsn the segment of loops 16 attached to the lighting device 11. Experience has shown that with repeated removal of the light from the cap 13, separation of the adhesively attached loops from the body of the light may occur unless the segment of hooks is shorter than the segment of loops.

The lens cover 12 serves to protect the lens shield 23 of the lighting device 11. In addition, the transparent lens cover 12 may contain various colored pigments or other components. An example would be a red pigment which would preserve night vision by protecting the rods and cones of the retina of airplane pilots, yet still provide sufficient illumination with which to read instruments. It could also be used, for example, in film developing enclosures.

Figure 4:
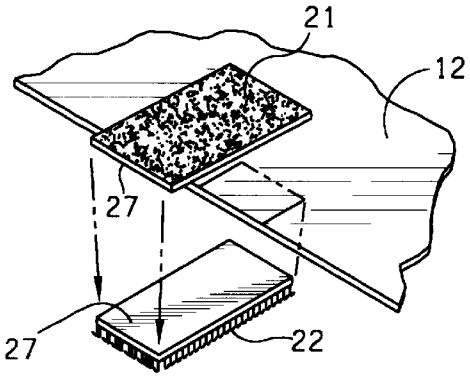
FIG. 4 is an expanded illustration of the method of forming a single member 28 which serves to attach to and remove the lens cover 12 from the lighting device 11.

FIG. 4 demonstrates the method for partially adhering the segment of hooks 22 to the inside of the lens cover 12, and the segment of loops 21 to the outside of the lens cover 12, so that a combined member 27 results. This member 27, as illustrated in FIG. 2 and FIG. 3, permits the lens cover 12 to be attached or removed from the lighting device 11.

FIG. 5 and 6 demonstrate two embodiments of the present invention. In FIG. 5, a single wide angled halide light 32 is facing forward and secured to housing 19 of lighting device 11. Positioned on the top surface of housing 19 is the on/off switch 25 which is electrically connected to the batteries 26 and the halide light 32. End caps 36, positioned on either side of housing 19, are removable to gain access to the battery storage compartment for replacing exhausted power cells (batteries) 26. Also shown are the segments of loops 21 secured to lens cover 12 and segments of hooks 22 secured to housing 19 which are intended to engage each other for the purpose of placing over and alternately removing lens cover 12 from the lighting device 11.

In FIG. 6, an alternate embodiment is shown, where lighting device 11 contains two or more individual halide lights 34, facing forward and secured in housing 19 of lighting device 11. Positioned on the top surface of housing 19 is the on/off switch 25 which is electrically connected to the batteries 26 and the halide light 32. End caps 36, positioned on either side of housing 19, are removable to gain access to the battery storage compartment for replacing exhausted power cells (batteries) 26. Also shown are the segments of loops 21 secured to lens cover 12 and segments of hooks 22 secured to housing 19 which are intended to engage each other for the purpose of placing over and alternately removing lens cover 12 from the lighting device 11.

I claim:

1. A lighting apparatus for illuminating darkness which comprises:

a cap having a crown and a bill;

said cap having a first series of fixedly attached hooks engaged to said crown and said bill; and a halide lighting device having a second series of fixedly attached loops which are removably attached to said first series of fixedly attached hooks.

2. The lighting apparatus as defined in claim 1, further comprising a lens cover having a third series of fixedly attached hooks which is removably attached to said first series of fixedly attached hooks.

3. The lighting apparatus as defined in claim 2, wherein said lens cover may be pigmented red to obstruct certain wave lengths of light.

4. The lighting apparatus as defined in claim 1, wherein said first series of fixedly attached hooks on said cap are shorter then said second series of fixedly attached hooks on said lighting device.

5. The lighting apparatus as defined in claim 1, wherein said halide lighting device comprises a single wide angled halide light.

6. The lighting apparatus as defined in claim 1, wherein said halide lighting device comprises one of more halide lights.

7. The lighting apparatus as defined in claim 1, wherein said first series of fixedly attached hooks are mounted to said cap by sewing means.

8. The lighting apparatus as defined in claim 1, wherein said second series of fixedly attached hooks are mounted to said lighting device by sewing means.

9. The lighting apparatus as defined in claim 1, wherein said first series of fixedly attached hooks are mounted to said cap by ashesive means.

10. The lighting apparatus as defined in claim 1, wherein said second series of fixedly attached hooks are mounted to said lighting device by adhesive means.

11. A lighting apparatus for illuminating darkness which comprises:

a cap having a crown and a bill;

said cap having a first series of fixedly attached hooks engaged to said crown and said bill;

a housing assembly having a second series of fixedly attached loops which are removably attached to said first series of fixedly attached hooks;

a transparent front shield secured to the front of said housing assembly;

one or more batteries positioned within said housing assembly;

one or more halide lights secured inside said housing assembly; and a switch electrically connecting said batteries to said halide lights.

* * * * *